US005645967A

United States Patent [19]

Sato et al.

[11] Patent Number: 5,645,967

[45] Date of Patent: Jul. 8, 1997

[54] CHARGE CONTROLLING AGENT COMPOSITION AND TONER CONTAINING SAID COMPOSITION

[75] Inventors: Sinichi Sato; Nobuo Suzuki; Hiroyoshi Yamaga; Sigeo Hosaka, all of Tokyo, Japan

[73] Assignee: Hodogaya Chemical Company Limited, Kawasaki, Japan

[21] Appl. No.: 379,444

[22] PCT Filed: Aug. 5, 1993

[86] PCT No.: PCT/JP93/01102

§ 371 Date: Feb. 3, 1995

§ 102(e) Date: Feb. 3, 1995

[87] PCT Pub. No.: WO94/03841

PCT Pub. Date: Feb. 17, 1994

[30] Foreign Application Priority Data

Aug. 5, 1992 [JP] Japan ..... 4-227804
Jul. 16, 1993 [JP] Japan ..... 5-197641

[51] Int. Cl.[6] ..... G03G 9/097

[52] U.S. Cl. ..... 430/110; 430/106; 430/109

[58] Field of Search ..... 430/106, 109, 430/110

[56] References Cited

U.S. PATENT DOCUMENTS

| | | | |
|---|---|---|---|
| Re. 32,883 | 3/1989 | Lu | 430/110 |
| 4,304,830 | 12/1981 | Bolte et al. | 430/110 |
| 4,925,765 | 5/1990 | Madeleine | 430/110 |
| 5,166,027 | 11/1992 | Machida et al. | 430/110 |
| 5,360,691 | 11/1994 | Koizumi et al. | 430/110 |
| 5,370,959 | 12/1994 | Hagiwara et al. | 430/110 |
| 5,389,483 | 2/1995 | Kawasaki et al. | 430/110 |
| 5,424,161 | 6/1995 | Hayashi et al. | 430/110 |

FOREIGN PATENT DOCUMENTS 0 488 742 6/1992 European Pat. Off. .

*Primary Examiner*—Hoa Van Le

*Attorney, Agent, or Firm*—Oblon, Spivak, McClelland, Maier & Neustadt, P.C.

[57] ABSTRACT

The present invention relates to a toner for electrophotography, and an object of the present invention is to improve various characteristics of the toner for electrophotography. A charge controlling agent composition obtained either by adding carbon therein during the preparation of the charge controlling agent or by mixing the charge controlling agent with carbon in the presence of a solvent, and an electro-photographic toner containing said composition are provided. The charge controlling agent composition wherein the charge controlling agent and carbon are uniformly dispersed, has excellent dispersibility in the resin, is freed from the problems of charging unstableness and scattering, and can provide an electro-photographic toner which provides a clear copied image.

4 Claims, No Drawings

CHARGE CONTROLLING AGENT COMPOSITION AND TONER CONTAINING SAID COMPOSITION

FIELD OF THE INVENTION

This invention relates to a charge controlling agent composition useful for toners which are developers for electrophotography. It also relates to an electro-photographic toner containing said composition.

BACKGROUND

In electrophotography, an electrostatic latent image is generally formed on a photoreceptor comprising a photocondutive substance, etc. and developed with a developer to form a visible image. The resulting visible image is then fixed by heat or a solvent.

A mixture of a fine powder comprising a resin and a colorant, called a toner, and fine iron powder or ferrite powder, called a carrier, is used as the developer for electrophotography.

Since the photoconductive layer can be charged positively or negatively, a positive or negative electrostatic latent image can be obtained when the original is exposed to light. Hence, when a negatively charged electrostatic latent image is developed with a positively charged developer, a positive-positive image corresponding to the original is formed. Generally, the developer is a fine powder obtained by mixing a colorant such as a dye or a pigment with a synthetic resin. The charging characteristics of the developer are influenced by the synthetic resin which is the principal ingredient.

Usually, a charge controlling agent is added to the developer to obtain desired friction charging characteristics.

Generally, particles comprising a colorant such as carbon or a color pigment dispersed in a thermoplastic resin or further containing a charge controlling agent for controlling the quantity of charge are used as toners for electrophotography. Many charge controlling agents such as nigrosine, aniline black, quaternary ammonium salts and metal complex salt dyes are conventionally used. Usually, these charge controlling agents are dispersed in the resin by adding carbon and the charge controlling agent to the resin molten by heating and kneading the resulting mixture. In fine particles such as particles of carbon or the charge controlling agent, however, primary particles are generally apt to aggromerate, thereby forming secondary particles. Further, they are affected by compatibility with the resin and have a difficulty in uniformly mixing with the resin. Thus, various problems with regard to the characteristics of the toners are caused.

Particularly, it is very important whether the charge controlling agent is uniformly dispersed in the resin. It is conventionally considered that various characteristics of the toners are greatly affected by the dispersibility of the charge controlling agent. To solve these problems, a twin screw heating kneader which applies intensively shear has to be used, or kneading with heating has to be carried out for many hours at present. However, these methods have disadvantages in that much electric heating rates are required, productivity is low, and the cost of equipment is high.

Further, toners prepared by these methods are still insufficient with regard to the uniform dispersion of the charge controlling agent and carbon in the resin, and hence problems with regard to unstable charging performance and scattering still remain unsolved.

JP-A-4-281467 (the term "JP-A" as used herein means an "unexamined published Japanese patent application") discloses a method wherein carbon and the charge controlling agent are mechanically dry-mixed with each other, and the resulting composition is used to prapare a toner, thereby improving the durability and charge stability of the toner.

However, the method disclosed therein has problems in that carbon and the charge controlling agent can not be uniformly mixed, an effect of improving various performances of the toner is insufficient, the quantity of charge is lowered when used for many hours, and the scattering of the toner and a defect in the image occur.

Accordingly, an object of the present invention is to provide a charge controlling agent composition wherein the charge controlling agent and carbon are uniformly dispersed, thereby solving the problems associated with the performances of conventional toners.

Another object of the present invention is to provide a toner comprising the resin, the charge controlling agent and carbon uniformly dispersed therein, which has good charging characteristic stability and does not suffer from scattering and a defect in the image.

DISCLOSURE OF THE INVENTION

The present inventors have extensively made studies to achieve the above objects and found that when either carbon is added during the course of the preparation of the charge controlling agent or the charge controlling agent and carbon are mixed in the presence of a solvent, the resulting charge controlling agent composition has good dispersibility in the resin. Further, the present inventors have ascertained that the toner prepared by using the charge controlling agent composition prepared above is free from the above-described that is, the problems of the unstability of the charging performances and the scattering of the toner. The present invention has been accomplished on the basis of the above finding.

Namely, the present invention provides a charge controlling agent composition obtained by either adding carbon during the course of the preparation of the charge controlling agent or mixing the charge controlling agent and carbon in the presence of a solvent. It also provides a toner containing said composition.

Conventional charge controlling agents can be used. Examples of the charge controlling agents which can be used include metal complex salt dyes such as C.I. Solvent Black 22, Solvent Violet 21 and metal complex salt dyes described in JP-B-43-17995 (the term "JP-B" as used herein means an "examined Japanese patent publication"), JP-B-43-27596, JP-B-44-6397, JP-A-57-141452, JP-A-58-208750, JP-A-58-185635, JP-A-59-78361, JP-A-59-93457, JP-A-59-228259, JP-A-60-100546, JP-A-60-101546, JP-A-61-91667, JP-A-61-155463, JP-A-61-155464, JP-A-3-107864, JP-B-3-57473 and JP-A-3-149568; phthalocyanine compounds such as C.I. Solvent Blue 25, C.I. Solvent Blue 55 and phthalocyanine compounds described in JP-B-54-3372, JP-A-4-186365, JP-A-4-186369 and JP-A-52-45931; basic dyes, for example, anthraquinone basic dyes such as C.I. Solvent Blue 11, C.I. Solvent Blue 14 and anthraquinone basic dyes described in JP-B-55-42383, JP-A-57-10149, JP-B-57-42860 and JP-B-58-136048, quinoimine basic dyes such as C.I. Solvent Black 5, C.I. Solvent Black 7, C.I. Basic Red 2, C.I. Basic Blue 3, C.I. Basic Blue 9 and quinoimine (azine, oxazine, thiazine) basic dyes described in JP-B-42-1627, JP-A-59-68374 and JP-A-2-102269, C.I. Pigment Red 81, C.I. Basic Violet 10, xanthene basic dyes described in JP-B-59-9906, azo basic dyes as typically C.I. Basic Brown 1 and di- and triallylmethane basic dyes such as C.I. Basic Yellow 2, C.I. Basic Violet 14 and C.I. Basic Violet 1; pigments derived from the basic dyes; disperse dyes such as C.I. Disperse Orange 1, C.I. Disperse Orange 11 and C.I. Disperse Blue 22; direct dyes; acid dyes; quaternary ammonium salt compounds such as quaternary ammonium salts and polymers having an amino group or a quaternary ammonium residue described in JP-A-57-119364, JP-A-58-9154, JP-A-58-98742, JP-A-60-169857, JP-A-62-71968, JP-A-62-87974, JP-A-62-53944, JP-A-64-54, JP-A-59-189351, JP-A-189354, JP-A-61-258270, JP-A-62-210472, JP-A-64-40168, JP-A-4-31584, JP-A-4-96072, JP-A-4-121754, JP-A-4-147268, JP-A-4-202305 and JP-A-4-214570; metal salts of higher fatty acids; metal complexes of acetylacetone; organophosphorus compounds described in JP-A-61-260258 and JP-A-4-107569; organotin compounds described in JP-A-4-107568 and JP-A-61-259267; imidazole compounds and guanazine compounds described in JP-A-61-217055, JP-A-61-259265, JP-A-1-262555 and U.S. Pat. No. 5,098,811; organic carboxylic acids described in JP-A-3-243959 and JP-A-4-244046; metal complexes of organic acids such as salicylic acid, naphthoic acid, dicarboxylic acids and anthranilic acid described in JP-B-55-42752, JP-B-58-41508, JP-B-59-7384, JP-A-61-69073, JP-A-61-141453, JP-A-61-246758, JP-A-62-94856 and JP-A-3-112990; organoboron compounds described in U.S. Pat. No. 4,767,688 and JP-A-1-306861; phenolic derivatives described in JP-A-61-3149, JP-A-63-38958 and JP-A-63-266462; thiourea derivatives described in JP-A-61-110157; and nitrohumic acid and salts thereof described in JP-A-50-133338.

Of these compounds, metal complex salt dyes, triarylmethane basic dyes, Nigrosine dyes, phthalocyanine, dyes derived from phthalocyanine, xanthene pigments, metal complexes of organic carboxylic acids, tetraaryl borate salts and quaternary ammonium salts are particularly preferred from the standpoint of dispersibility.

Examples of the metal complex salt dyes include compounds represented by the following general formulas (1) and (2).

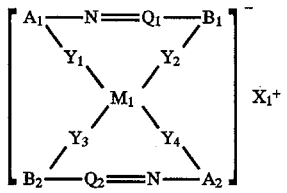

(1)

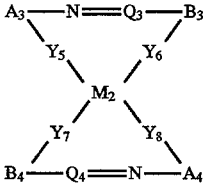

(2)

In general formulas (1) and (2) $M_1$ represents chromium, cobalt or iron atom; $M_2$ represents titanium, zirconium or silicon atom; $Q_1$ to $Q_4$ each represents N or CH; $Y_1$ to $Y_8$ each represents O, NH or COO; $A_1$ to $A_4$ and $B_1$ to $B_4$ each represents a phenyl group or a naphthyl group, which may be optionally substituted by one or more substituent groups selected from the group consisting of a $C_{1-8}$ alkyl group, a $C_{1-4}$ alkoxy group, a $C_{1-4}$ alkylsulfone group, a $C_{1-4}$ alkylaminosulfone group, an acetylamino group, a sulfonamido group, a benzoylamino group, a phenylsulfone group, a nitro group, a halogen atom, a hydroxyl group, —COOH, —$SO_3H$, —$SO_2CH_3$, —$COOR_1$ [wherein $R_1$ is a $C_{6-30}$ aryl group or a $C_{1-30}$ alkyl group], —$CONHR_2$ [wherein $R_2$ is a $C_{6-30}$ aryl group or $C_{1-30}$ alkyl group] and a $C_{5-12}$ cyclic alkyl group, and $A_1$ to $A_4$ and $B_1$ to $B_4$ may be the same or different; and $X_1^+$ represents $H^+$, $K^+$, $Na^+$, $1/2Mg^{2+}$, $1/2Ca^{2+}$, $1/2Ba^{2+}$, $NH_4^+$ or a quaternary ammonium cation represented by the following general formula (3)

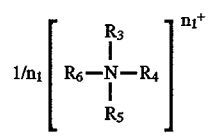

(3)

wherein $n_1$ represents an integer of 1 to 3; and $R_3$ to $R_6$ each represents a hydrogen atom, a $C_{1-30}$ alkyl group a $C_{7-30}$ aralkyl group or a $C_{6-30}$ aryl group, each of which may optionally have one or more substituent groups selected from the group consisting of an amino group, an ether group, a thioether group, an alkoxy group, a hydroxyl group, a carbonamido group, a sulfonamido group, a urethane group, a chloromethyl group, a nitro group, a halogen atom (F, Cl, Br), a $C_{6-30}$ aryl group and a $C_{6-30}$ aromatic heterocyclic group. $R_3$ to $R_6$ may have a quaternized amino group. Any two of $R_3$ to $R_6$ may be combined together to form an alicyclic or aromatic ring.

Examples of the triarylmethane basic dyes include compounds represented by the following general formula (4)

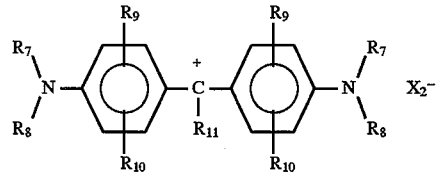

(4)

wherein $R_7$ to $R_{10}$ may be the same or different and each represents a hydrogen atom or a $C_{1-5}$ alkyl group, $R_{11}$ represents a phenylene group or a naphthyl group (each of these groups may be substituted by one or more substituent groups selected from the group consisting of a $C_{1-8}$ alkyl group, a $C_{1-4}$ alkoxy group, a $C_{1-4}$ alkyl-sulfone group, a $C_{6-10}$ aryl group, a nitro group, an amino group, a hydroxyl group, a chloromethyl group, —$SO_3H$ and —$SO_3CH_3$), and $X_2^-$ represents a halogen atom ($Cl^-$, $Br^-$, $I^-$), $ClO_4^-$, $BF_4^-$, $PF^-$, a metal hexafluoride anion ($AlF_6^{3-}$, $FeF_6^{2-}$, $PtF_6^{2-}$, $ZrF_6^{2-}$, $SiF_6^{2-}$, $TiF_6^{2-}$, etc.), sulfate ion, methylsulfate ion, nitrate ion, borate ion, phosphate ion or a carboxylate ion (an anion such as acetate ion, benzoate ion, stearate ion or oleate ion).

Examples of the nigrosine dye include compounds represented by the following general formula (5)

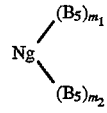

(5)

wherein Ng represents the residue of the nigrosine dye; $B_5$ and $B_6$ each represents a hydrogen atom or each is a halogen atom, a $C_{1-30}$ alkyl group, a $C_{7-30}$ aralkyl group, a $C_{6-30}$ aryl group or a $C_{1-30}$ aliphatic amino group which is attached to the skeleton of the residue of the nigrosine dye (each of these groups may optionally have one or more of an amino group, an ether linkage, a thioether linkage, an alkoxy group, a hydroxyl group, a carbonamido group, a sulfonamido group, a urethane linkage, a chloromethyl group, a nitro group, a $C_{6-30}$ aryl group and a $C_{6-30}$ aromatic heterocyclic group;

and $m_1$ and $m_2$ each represents an integer of 1 to 8 provided that $m_1+m_2$ is in the range of 2 to 8.

Examples of the phthalocyanine include compounds represented by the following general formula (6)

$$M_3P_c—(Y_9)_l \quad (6)$$

wherein $M_3$ represents Cu atom or Ti atom; Pc represents a phthalocyanine residue which may be substituted by a halogen atom; l represents an integer of 1 to 4; and $Y_9$ represents a hydrogen atom or a $C_{1-30}$ alkyl group, a $C_{7-30}$ aralkyl group, a $C_{6-30}$ aryl group or a sulfone group (which may be substituted by one or more substituent groups selected from the group consisting of an amino group, an ether group, a thioether group, a urethane group, a chloromethyl group, a nitro group, a $C_{6-30}$ aryl group and a $C_{6-30}$ aromatic heterocyclic group) which is attached to the phthalocyanine residue.

Examples of the xanthene pigments include compounds represented by the following general formula (7)

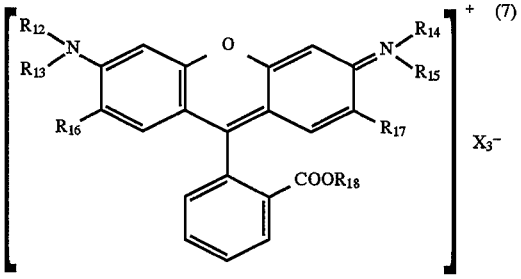

(7)

wherein $R_{12}$, $R_{14}$, $R_{16}$, $R_{17}$ and $R_{18}$ may be the same or different and each represents a hydrogen atom or a $C_{1-20}$ alkyl group; $R_{13}$ and $R_{15}$ each represents a $C_{1-20}$ alkyl group; and $X_3^-$ represents a halogen atom ($Cl^-$, $Br^-$, $I^-$), $ClO_4^-$, $BF_4^-$, $PF_4^-$, a metal hexafluoride anion (Al, Fe, Pt, Zr, Si, Ti, etc.), sulfate ion, methylsulfate ion, nitrate ion, borate ion, phosphate ion or a carboxylate ion (an anion such as acetate ion, benzoate ion, stearate ion, oleate ion). The lake compounds of these pigments can also be used. The lake formation can be carried out by conventional methods using phosphotungstmolybdic acid, phosphotungstic acid or phosphomolybdic acid.

Examples of the metal complex salts of organic carboxylic acids include compounds represented by the following general formula (8)

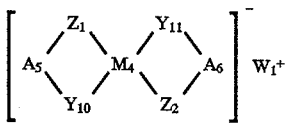

(8)

wherein $M_4$ represents a metal selected from the group consisting of Fe, Cr, Zn, Co, Cu, B, Al and Ni; $Z_1$ and $Z_2$ may be the same or different and each represents COO, O, S, NH or $SO_3$; $Y_{10}$ and $Y_{11}$ may be the same or different and each represents COO, O, S, NH, $SO_3$, $SO_2NR_{19}$ (wherein $R_{19}$ is a $C_{1-10}$ alkyl group) or $NR_{20}$ (wherein $R_{20}$ is a $C_{1-10}$ alkyl group); $A_5$ and $A_6$ each represents an aryl group represented by the following general formula (9)

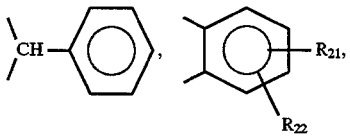

(9)

-continued

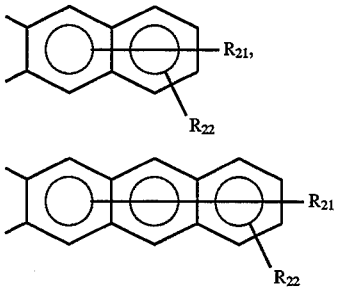

(wherein $R_{21}$ represents a hydrogen atom, a halogen atom, a nitro group, a $C_{1-30}$ alkyl group or a $C_{7-30}$ alkenyl group; and $R_{22}$ represents a hydrogen atom, a halogen atom or a $C_{1-30}$ alkyl group which may be substituted by one or more substituent groups selected from the group consisting of an amino group, an ether linkage, a thioether linkage, an alkoxy group, a hydroxy group, a carbonamido group, a sulfonamido group, a urethane linkage, a chloromethyl group and a nitro group) or an aryl group represented by the following general formula (10)

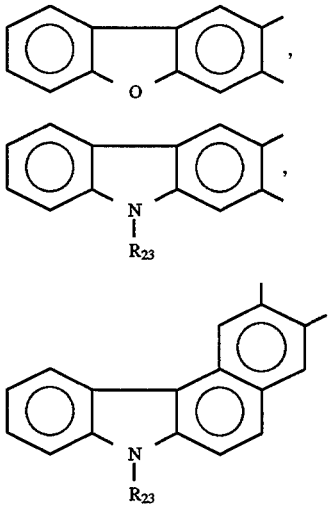

(10)

(wherein $R_{23}$ represents a $C_{1-30}$ alkyl group or a $C_{7-30}$ alkenyl group); and $W_1^+$ represents $H^+$, $Li^+$, $Na^+$, $K^+$, $Ag^+$, $1/2Mg^{2+}$, $1/2Ca^{2+}$, $1/2Ba^{2+}$, $1/2Ni^{2+}$, $1/2Zn^{2+}$, $NH_4^+$ or a quaternary ammonium cation of general formula (3).

Examples of the tetraarylborate salts include compounds represented by the following general formula (11)

$$[Ar]_4B^- \quad W_2^+ \quad (11)$$

wherein Ar represents a $C_{6-30}$ aryl group which may be substituted by a halogen atom or a methyl group; and $W_2^+$ represents $H^+$, $Li^+$, $Na^+$, $K^+$, $Ag^+$, $1/2Mg^{2+}$, $1/2Ca^{2+}$, $1/2Ba^{2+}$, $1/2Sr^{2+}$, $1/2Pb^{2+}$, $1/2Mn^{2+}$, $1/2Co^{2+}$, $1/2Ni^{2+}$, $1/2Zn^{2+}$, $NH_4^+$ or a quaternary ammonium cation of general formula (3).

Examples of the quaternary ammonium salts include compounds represented by the following general formula (12)

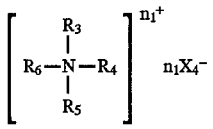

(12)

wherein the cation moiety represents an organoammonium cation of general formula (3); $n_1$ represents an integer of 1 to 3; $X_4$ _ represents a halogen atom ($Cl^-$, $Br^-$, $I^-$), $ClO_4^-$, $BF_4^-$, $PF_4^-$, sulfate ion, nitrate ion, borate ion, phosphate ion, methylsulfate ion, an organic phosphate ion (e.g., phenylphosphate ion), a carboxylate ion (an anion such as acetate ion, benzoate ion, stearate ion, oleate ion), a metal hexafluoride ion ($AlF_6^{3-}$, $FeF_6^{2-}PtF_6^{2-}$, $ZrF_6^{2-}$, $SiF_6^{2-}$, $TiF_6^{2-}$), a tetraphenyl borate ion (e.g., an anion such as tetraphenyl borate ion, p-chlorotetraphenyl borate ion, p-methylphenyl borate ion, tetranaphthyl borate ion), a cyanate ion (an anion such as zinc tetracyanate ion, zinc tetrathiocyanate ion), a phenolate ion (an anion such as phenol ion, p-chloro-phenol ion, o-chlorophenol ion), a polyacid ion containing molybdenum atom or tungsten atom (an anion such as molybdate ion, tungstate ion, heteropolyacid ion containing molybdenum atom or tungsten atom) or an organic sulfonate anion represented by the following general formula (13) or (14)

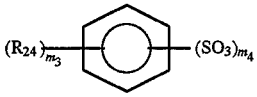

(13)

wherein $m_4$ represents 1 or 2; $m_3$ represents 0, 1 or 2; when $m_3$ is 2, two $R_{24}$ groups may be the same or different and $R_{24}$ represents a $C_{1-30}$ alkyl group, a $C_{7-30}$ aralkyl group, a $C_{6-30}$aryl group, a $C_{1-30}$ alkoxy group or a $C_{6-30}$ aryloxy group; one or two sulfo groups may be attached to each group, when $m_3$ is 2, two $R_{24}$ groups may be combined together to form a heterocyclic ring, an alicyclic ring or an aromatic heterocyclic ring; or $R_{24}$ may be a hydroxyl group or an amino group.

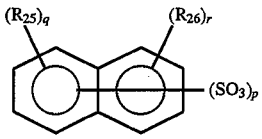

(14)

wherein p represents 1 or 2; q and r each represents 0, 1 or 2; $R_{25}$ and $R_{26}$ may be the same or different and each represents a $C_{1-30}$ alkyl group, a $C_{7-30}$ aralkyl group, a $C_{6-30}$ aryl group, a $C_{1-30}$ alkoxy group or a $C_{6-30}$ aryloxy group; one or two sulfo groups may be attached to each group; when q is 1 or 2 and r is 1 or 2, $R_{25}$ and $R_{26}$ may be combined together to form a heterocyclic ring, an alicyclic ring or an aromatic heterocyclic ring; or $R_{25}$ or $R_{26}$ may be hydroxyl group or an amino group.

Further, oligomers or polymers having a quaternary ammonium salt group can be used as the quaternary ammonium salts. Examples thereof include oligomers or polymers represented by the following general formula (15)

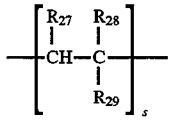

(15)

wherein $R_{27}$ represents a hydrogen atom or a $C_{1-10}$ alkyl group; $R_{28}$ and $R_{29}$ may be the same or different and each represents a $C_{1-30}$ alkyl group, a $C_{1-30}$ alkoxy group, a $C_{7-30}$ aralkyl group, a $C_{6-30}$ aryl group or a $C_{6-30}$ aryloxy group (each group may be substituted by one or more substituent groups selected from the group consisting of an ether linkage, a thioether group, a carbonamido group, a sulfonamido group, a urethane linkage, a chloromethyl group, a nitro group and pyridium group; either $R_{28}$ or $R_{29}$ has a quaternary ammonium salt group; s represents an integer of 2 to 100.

The quaternary ammonium salts of oligomers and polymers obtained from monomers represented by the following general formulas (16) to (21) can be used.

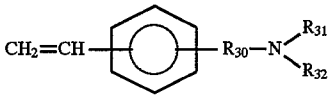

(16)

wherein $R_{30}$ represents a $C_{6-12}$ alkylene group; and $R_{31}$ and $R_{32}$ independently represent a hydrogen atom or a $C_{1-30}$ alkyl group.

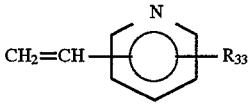

(17)

wherein $R_{33}$ represents a hydrogen atom or a $C_{1-10}$ alkyl group.

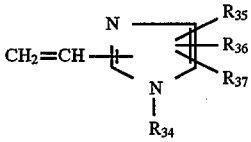

(18)

wherein $R_{34}$ to $R_{37}$ independently represent a hydrogen atom or a $C_{1-20}$ alkyl group.

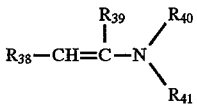

(19)

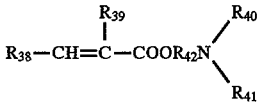

(20)

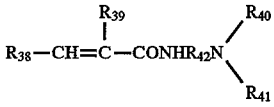

(21)

wherein $R_{38}$ and $R_{39}$ independently represent a hydrogen atom or a $C_{1-10}$ alkyl group; $R_{40}$ and $R_{41}$ independently represent a hydrogen atom, a $C_{1-20}$ alkyl group or a $C_{6-20}$ aryl group; and $R_{42}$ represents a $C_{1-20}$ alkylene group.

The charge controlling agents of the present invention may be used either alone or in combination of two or more of them.

Carbon can be used in the present invention, irrespective of pH, particle size, hue, etc. Any carbon in addition to those conventionally used for toners can be used in the present invention, so long as carbon has sufficient blackness for use in the toners and can be uniformly dispersed with the charge controlling agents. Carbon has a mean particle size of preferably 0.01 to 5 μm.

Carbon is used in the charge controlling agent composition of the present invention in such an amount that the characteristics of the charge controlling agent composition as the charge controlling agent are not deteriorated by carbon.

The charge controlling agent and carbon are used in a ratio by weight of from 200:1 to 1:200, preferably from 20:1 to 1:20.

Generally, the charge controlling agents are obtained through such stages that after the reaction stage, purification is carried out through some stages, and filtration, drying and crushing are conducted. In the charge controlling agent obtained in this manner, primary particles are apt to grow into secondary particles by compression during filtration or during the drying stage.

When the particles size is enlarged as described above, it is difficult that the charge controlling agent is finelly divided in the crushing stage. The charge controlling agent together with carbon is kneaded with a resin during the preparation of the toner. However, it is hard to uniformly disperse the charge controlling agent having the enlarged particle size in the resin even when they are kneaded with heating as long as possible while shearing is intensely applied thereto. Particularly, when the charge controlling agent has poor compatibility with the resin, it is more hard to uniformly disperse the charge controlling agent in the resin.

In the present invention, the charge controlling agent composition is prepared by adding carbon during the preparation of the charge controlling agent, separating a mixture of the charge controlling agent formed and carbon and drying it. Carbon may be added before, after or during the synthesis stage of the charge controlling agent. Carbon may be added during the refining stage of the charge controlling agent or after completion of the refining stage after completion of the reaction stage. It is preferred that carbon is added after completion of the reaction stage or the refining stage, and a mixture of the charge controlling agent and carbon is recovered by filtration and dried.

Alternatively, the dry charge controlling agent and carbon are mixed in an appropriate solvent, and the resulting mixture is dried, thereby obtaining the charge controlling agent composition of the present invention. The mixing of the charge controlling agent with carbon can be made in the following manner. A small amount of a solvent is added to a mixture of the charge controlling agent and carbon, the resulting mixture is kneaded to form a slurry, and slurry is stirred, whereby mixing can be effected. Examples of the solvent which can be used in the mixing of the charge controlling agent with carbon include water, organic solvents and the mixtures of water and the organic solvents. Examples of the organic solvents include alcohols such as methanol, ethanol, propanol and butanol; ketones such as acetone and methyl isobutyl ketone (MIBK); dimethylformaldehyde and dimethyl sulfonamide.

The thus-obtained charge controlling agent composition of the present invention as dried can be used for the preparation of the toner as it is after drying. If desired, the charge controlling agent composition may be further pulverized, classified and used.

The thus-obtained charge controlling agent composition according to the present invention is a mixture wherein the primary particles of the charge controlling agent and finely divided carbon particles are very well dispersed in each other, and the composition has excellent dispersibility in the resin.

However, when the charge controlling agent recovered as a dry product and carbon are mixed, that is, when dry powder products are mixed, the charge controlling agent is mixed in the form of secondary particles, carbon is mixed in an agglomerated state called accumulated state, and it is very hard to uniformly disperse and mix them. Even when they are kneaded with the resin under heating, it is difficult to uniformly disperse them as described above in the discussion about the problems associated with prior art.

On the other hand, it has been found that the composition of the charge controlling agent and carbon prepared according to the present invention is kneaded with the resin under heating, the charge controlling agent and carbon can be uniformly dispersed in the resin with ease. Further, since they can be uniformly dispersed with excellence, the problems with regard to the charging unstableness of the toner and the scattering of the toner associated with prior art can be solved.

The charge controlling agent composition of the present invention has good dispersibility in the resin, and the toner obtained by using the charge controlling agent composition has good rinsing of charging and does not cause the problems of the charging unstableness and scattering of the toner associated with prior art, even when the toner of the present invention is used under low temperature and low humidity conditions and under high temperature and high humidity conditions for many hours. Hence, the problems associated with prior art can be solved, and a clear developed image can be obtained.

In the preparation of two-component toner, a binder resin is first put in a mixer, and a colorant, a charge controlling agent and wax are added thereto. The resulting mixture is pre-mixed. The pre-mixture is kneaded in an extruder at a temperature of generally 150° C. or below, further pulverized and classified to obtain toner particles having a particle size of 5 to 25 μm. In the preparation of one-component toner, magnetic powder is used in place of the colorant, thereby obtaining a toner. A method of adding a magnetic powder into a two-component toner is disclosed.

A feature of the present invention resides in that the charge controlling agent composition of the present invention is used as the above-mentioned charge controlling agent.

The charge controlling agent composition is used in an amount of 0.1 to 15% by weight, preferably 0.5 to 10% by weight based on the amount of the toner. The composition has an average particle size of preferably 0.5 to 25 μm. The charge controlling agent used in the present invention has an average particle size of preferably 0.5 to 25 μm.

The toner of the present invention cotain a binder resin and a colorant in addition to the charge controlling agent composition.

Preferred examples of the binder resin for the toner include homopolymers of styrene and substituted styrenes such as polystyrene and polyvinyl toluene, styrene-substituted styrene copolymers, styrene-acrylic ester copolymers, styrene-methacrylic ester copolymers, styrene-acrylonitrile copolymers, polyvinyl chloride, polyethylene, polyesters, silicone resins, polyesters, polyurethanes, polyamides, epoxy resins, modified resins and phenolic resins. These binder resins may be used either alone or as a mixture of two or more of them.

Further, low-molecular polyethylene, low-molecular polybutene, low-molecular polypropylene, fatty acid esters such as ethyl maleate, butyl maleate, ethyl stearate, butyl stearate and cetyl palmitate, amide waxes such as stearamide, oleamide, palmitamide, laurylamide and ethylenebisstearoamide and carnaba wax can be used to improve fixing properties and adhesion.

Examples of the colorant include C.I. Pigment Yellow 12, C.I. Solvent Yellow 18, C.I. Disperse Yellow 33, C.I. Pigment Red 122, C.I. Solvent Red 19, C.I. Pigment Blue 15, C.I. Pigment Black 1, C.I. Solvent Black 3, C.I. Solvent Black 22 and carbon black. However, any of colorants which are conventionally used for the toners can be used in addition to the above-described colorants. The colorants are used in an amount of preferably 3 to 10% by weight based on the amount of the toner.

The toner particles of the present invention can be prepared in the following manner. The charge controlling agent composition in an amount of 1 to 50% by weight based on the amount of the synthetic resin is melt-mixed with the resin, and the mixture is solidified, coarsely crushed in a hammer mill and the like, pulverized in a jet mill and classified with a gas stream classifier. Alternatively, a polymerization initiator is added to a synthetic resin monomer. The charge controlling agent composition in an amount of 0.1 to 50% by weight based on the amount of the monomer is added thereto, and the mixture is polymerized by means of suspension polymerization in water, thereby preparing the toner particles. In this case, a dye or carbon as the colorant may be added.

The thus prepared toner provides charge quantity by friction between the toner and a carrier, said charge quantity being suitable for the development of the electrostatic latent image. Even when development is conducted for many hours, the toner is not affected by the change of humidity and temperature, charge quantity is kept constant, and the charge distribution is uniform and can be kept constant.

Examples of the carrier include iron powder and carriers obtained by coating a magnetic core with a styrene-methyl methacrylate copolymer, a silicone resin, a mixed resin of a styrnen-methyl methacrylate copolymer and a silicone resin, or a tetrafluorostyrene polymer.

The charge controlling agent composition of the present invention provides excellent charging characteristics even when the composition is applied to toners containing magnetic powder so-called one-component toners. Further, the charge controlling agent composition of the present invention can be applied to capsule toners and polymerization toners.

Examples of magnetic subsances which can be used as magnetic powder include fine powders of metals such as iron, nickel and cobalt, alloys of metals such as iron, cobalt, copper, aluminum, nickel and zinc, metal oxides such as aluminum oxide, iron oxide and titanium oxide, ferrites of iron, manganese, nickel, cobalt and zinc, nitrides such as vanadium nitride and chromium nitride, carbides such as tungsten carbide and silicon carbide and mixtures thereof.

Of these substances, iron oxides such as magnetite, hematite and ferrite are preferred as magnetic powder.

BEST MODE FOR PRACTICE OF THE INVENTION

The present invention is further illustrated in greater detail by means of the preparation examples of the composition and the application examples of the toner as examples. However, the invention is not intended to be construed as being limited to these examples. The amounts and parts of ingredients given in the following examples are by weight unless otherwise stated.

EXAMPLE 1

$$(C_{14}H_{29})_2N^{\oplus}(CH_3)_2 \cdot \tfrac{1}{4}[Mo_8O_{26}]^{4\ominus} \qquad \text{(Compound 1)}$$

There was dissolved 13.0 parts of N,N-dimethyl-N,N-ditetradecylammonium chloride in 100 parts of methanol. Five parts of carbon (R-300, a product of Cabot) was added thereto. Subsequently, an aqueous solution of 10 parts of ammonium molybdate tetrahydrate in 60 parts of water was added thereto. The mixture was stirred at 50° C., and the resulting white precipitate was recovered by filtration, thoroughly washed with water and dried to obtain a composition 1 composed of the compound 1 and carbon in a ratio of 80:20.

Subsequently, 88 parts of styrene-n-butyl methacrylate copolymer (Himer SBM-73 F., a product of Sanyo Kasei K.K.), 5 parts of low-molecular polypropylene (Viscol 550-P, a product of Sanyo Kasei K.K.) , 5 parts of carbon (#44 a product of Mitsubishi Kasei Corporation) and two parts of the composition 1 were placed in a chemical mixer and premixed for 10 minutes. The mixture was melt-kneaded in a heated roll mill at 120° C., pulverized and classified to obtain a toner having a particle size of 5 to 25 μm.

A developer was prepared by mixing 3 parts of the toner with 97 parts of an iron powder carrier (TEFV 200/300, a product of Nippon Teppun K.K.).

The toner was placed in a development device, and continuous copying was conducted to carry out an image test. In the initial stage of running, an image of good quality was obtained, and the image quality was not changed after 50,000 copies were obtained. The scattering of the toner and offset did not occur. Further, the copying test was carried out under high temperature and humidity conditions at 35° C. and 85% RH and under low temperature and humidity conditions at 10° C. and 30% RH. An image of good quality substantially equal to that obtained under ordinary temperature and humidity conditions was obtained. The scattering of the toner and offset did not occur.

EXAMPLE 2

There was dissolved 13.0 parts of the quaternary ammonium salt (compound 1) in 100 parts of methanol. Subsequently, an aqueous solution of 10.0 parts of ammonium molybdate tetrahydrate in 60 parts of water was added thereto. The mixture was stirred at 50° C., and the quaternary ammonium salt (compound 1) was recovered by filtration.

The wet cake was stirred and dispersed in 100 parts of water at room temperature. Five parts of the same carbon as that used in Example 1 was added thereto. The mixture was stirred, recovered by filtration, thoroughly washed with water and dried to obtain a composition 2 composed of the quaternary ammonium salt (compound 1) and carbon in a ratio of 80:20.

A toner was prepared in the same manner as in Example 1 except that the composition 2 was used in place of the composition 1. The toner was placed in a development device, and continuous copying was conduted to carry out an image test. In the initial stage of running, an image of good quality was obtained, and the image quality was not changed after 50,000 copies were obtained. The scattering of the toner and offset did not occur. Further, the toner provided an image of good quality under high temperature and humidity conditions and under low temperature and humidity conditions without being affected by high or low temperature and humidity enviromental conditions.

EXAMPLE 3

Twenty parts of the quaternary ammonium salt (compound 1) was stirred and dispersed in 100 parts of water at room temperature, and 5 parts of the same carbon as that used in Example 1 was added thereto. The mixture was stirred, recovered by filtration, thoroughly washed with water and dried to obtain a composition 3 composed of the quaternary ammonium salt (compound 1) and carbon in a ratio of 80:20.

A toner was prepared in the same manner as in Example 1 except that the composition 3 was used in place of the composition 1. The toner was placed in a development device, and continuous copying was conducted to carry out an image test. In the initial stage of running, an image of good quality was obtained, and image quality was not changed after 50,000 copies were obtained. Further, the toner provided an image of good quality under high temperature and humidity conditions and under low temperature and humidity conditions without being affected by high or low temperature and humidity environmental conditions.

Comparative Example 1

Eighty parts of the quaternary ammonium salt (compound 1) and 20 parts of carbon (R-300, a product of Cabot) were mixed in a Henschel mixer to obtain a composition 4.

Atoner was prepared in the same manner as in Example 1 except that the composition 4 was used in place of the composition 1. An image test was carried out in the same manner as in Example 1. In the initial stage of running, a clear image which did not suffer from fog was obtained.

However, after about 1,000 copies, the image obtained was not clear and suffered from fog.

Comparative Example 2

A toner was prepared in the same manner as in Example 1 except that the quaternary ammonium salt (compound 1) was used in place of the composition 1, and the following ingredients were used to prepare the toner.

| | |
|---|---|
| Styrene-n-butyl methacrylate copolymer resin (Himer SBM-73F, a product of Sanyo Kasei K.K.) | 88 parts |
| Low-molecular weight polypropylene (Viscol 550-P, a product of Sanyo Kasei K.K.) | 5 parts |
| Carbon (#44, a product of Mitsubishi Kasei Corporation) | 5 parts |
| Quaternary ammonium salt (compound 1) | 1.6 parts |
| Carbon(lack R-300, a product of Cabot | 0.4 parts |

An image test was carried out in the same manner as in Example 1. In the initial stage of running, a clear image which did not suffer from fog was obtained. However, after about 1,000 copies, the image obtained was not clear and suffered from fog.

EXAMPLES 4 TO 27 AND COMPARATIVE EXAMPLE 3 TO 26

Each of compositions 5 to 40 shown in Tables 1 to 6 below was prepared by adding carbon to the charge controlling agent in the same manner as in Example 3. The resulting compositions were used in Examples 4 to 27. For the purpose of comparison, toners were prepared by using the charge controlling agent and carbon in the same manner as in Comparative Example 2, and used in Comparative Examples 3 to 26. The results obtained are shown in Tables 7 to 10 below.

Resins used and the criterion of each evaluation are as follows:

The following resins were used for the preparation of the toners.

A: Styrene-acrylic acid copolymer (Himer SBM-73, a product of Sanyo Kasei K.K.)

B: Styrene-acrylic acid copolymer (Himer TB-1000, a product of Sanyo Kasei K.K.)

C: Polyester (HP-313, a product of Nippon Gosei Kagaku K.K.)

D: Polyester (HP-320, a product of Nippon Gosei Kagaku K.K.)

E: Polyester (average molecular weight: 15,000)

The charge quantity of the toner was determined by measuring the charge quantity in the initial stage of running and after the 50,000th copy by means of the blow-off method.

The mark ○: There is practically no problem.

The mark x: These is practically a problem.

TABLE 1

| Composition No. | Charge Cotrolling Agent (A) | Compound (No.) | Carbon (B) | Ratio by weight (A):(B) |
|---|---|---|---|---|
| 5 | 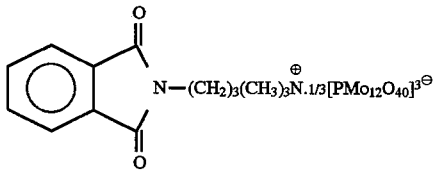 | (2) | R-300 (Cabot) | 30:70 |
| 6 | 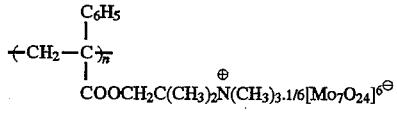 n = 2 ~ 300 average MW 1500 | (3) | R-300 (Cabot) | 80:20 |
| 7 | 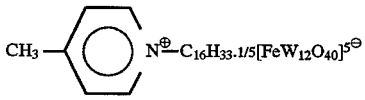 | (4) | R-300 (Cabot) | 40:60 |

TABLE 1-continued
| Composition No. | Charge Cotrolling Agent (A) | Compound (No.) | Carbon (B) | Ratio by weight (A):(B) |
|---|---|---|---|---|
| 8 | 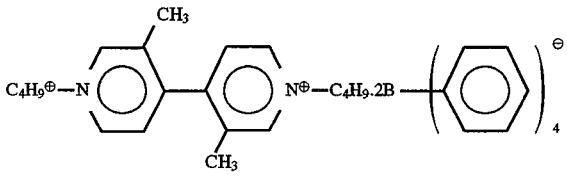 | (5) | #44 (Mitsubishi Kasei Corp | 60:40 |
| 9 | 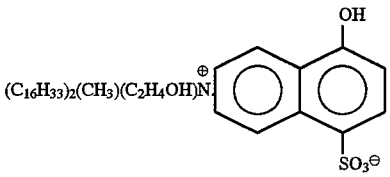 | (6) | #44 (Mitsubishi Kasei Corp | 90:10 |
| 10 | 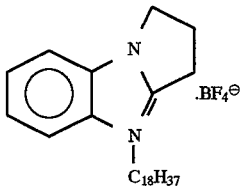 | (7) | #44 (Mitsubishi Kasei Corp | 30:70 |
| 11 | 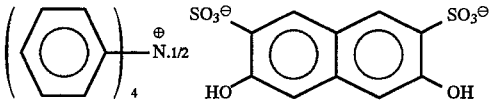 | (8) | ELFTEX (Cabot) | 50:50 |
TABLE 2
| Composition No. | Charge Cotrolling Agent (A) | Compound (No.) | Carbon (B) | Ratio by weight (A):(B) |
|---|---|---|---|---|
| 12 | 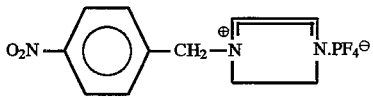 | (9) | ELFTEX-8 (Cabot) | 50:50 |
| 13 | 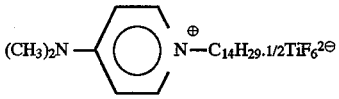 | (10) | ELFTEX-8 (Cabot) | 10:90 |
| 14 | 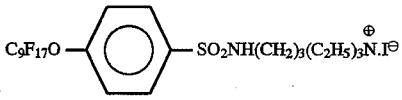 | (11) | ELFTEX-8 (Cabot) | 25:75 |
| 15 | 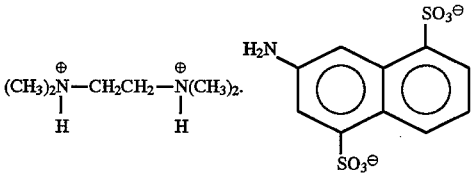 | (12) | ELFTEX-8 (Cabot) | 50:50 |
| 16 | C.I. Pigment Red 81 | (13) | #44 (Mitsubishi Kasei Corp.) | 90:10 |

TABLE 2-continued
| Composition No. | Charge Cotrolling Agent (A) | Compound (No.) | Carbon (B) | Ratio by weight (A):(B) |
|---|---|---|---|---|
| 17 | 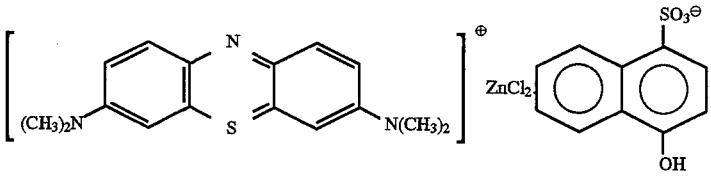 | (14) | R-400R (Cabot) | 90:10 |
| 18 | 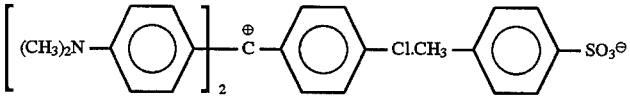 | (15) | R-400R (Cabot) | 10:90 |
TABLE 3
| Composition No. | Charge Cotrolling Agent (A) | Compound (No.) | Carbon (B) | Ratio by weight (A):(B) |
|---|---|---|---|---|
| 19 | 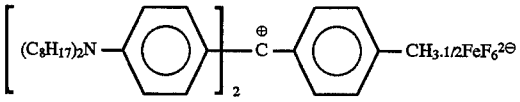 | (16) | R-400R (Cabot) | 80:20 |
| 20 | 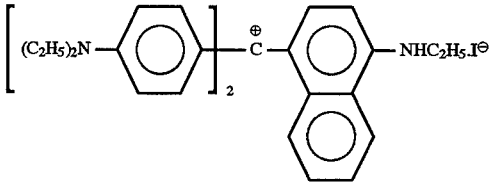 | (17) | #44 (Mitsubishi Kasei Corp.) | 90:10 |
| 21 | 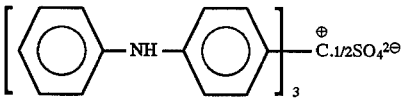 | (18) | #44 (Mitsubishi Kasei Corp.) | 80:20 |
| 22 | Nigrosine Base (C.I. Solvent Black 7) | (19) | #44 (Mitsubishi Kasei Corp.) | 50:50 |
| 23 | 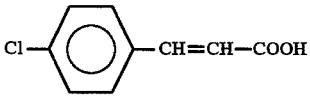 | (20) | #44 (Mitsubishi Kasei Corp.) | 60:40 |
| 24 | 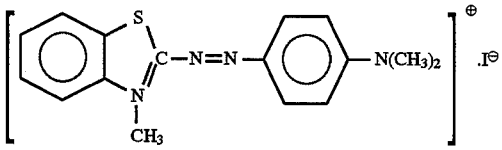 | (21) | R-300 (Cabot) | 50:50 |
| 25 | 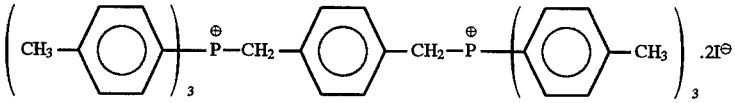 | (22) | R-300 (Cabot) | 20:80 |

TABLE 4
| Composition No. | Charge Cotrolling Agent (A) | Compound (No.) | Carbon (B) | Ratio by weight (A):(B) |
|---|---|---|---|---|
| 26 | 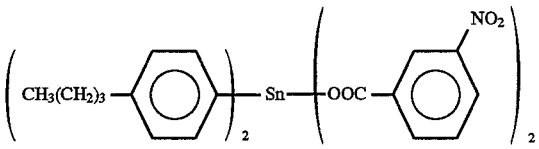 | (23) | R-300 (Cabot) | 50:50 |
| 27 | 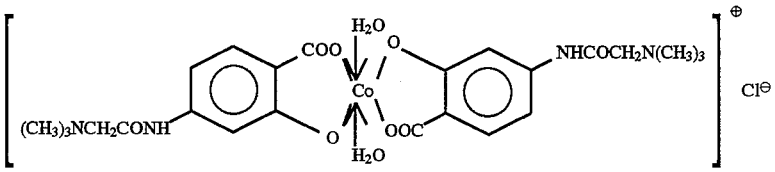 | (24) | #20B (Mitsubishi Kasei Corp.) | 30:70 |
| 28 | 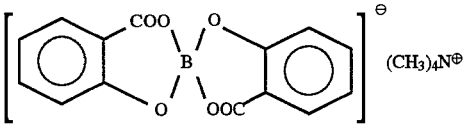 | (25) | #20B (Mitsubishi Kasei Corp.) | 50:50 |
| 29 | 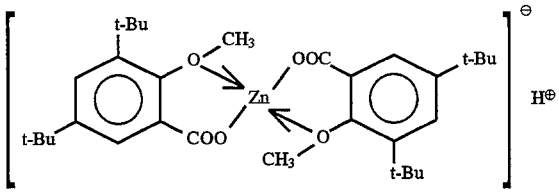 | (26) | #20B (Mitsubishi Kasei Corp.) | 10:90 |
| 30 | 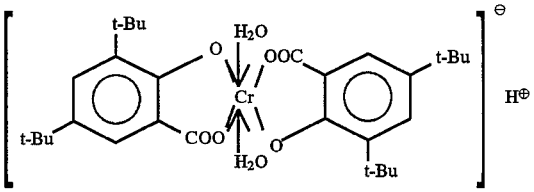 | (27) | #20B (Mitsubishi Kasei Corp.) | 70:30 |
| 31 | 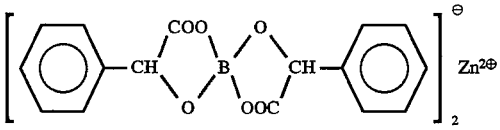 | (28) | R-400R (Cabot) | 50:50 |
TABLE 5
| Composition No. | Charge Cotrolling Agent (A) | Compound (No.) | Carbon (B) | Ratio by weight (A):(B) |
|---|---|---|---|---|
| 32 | 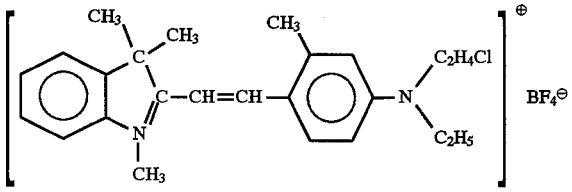 | (29) | R-400R (Cabot) | 10:90 |
| 33 | 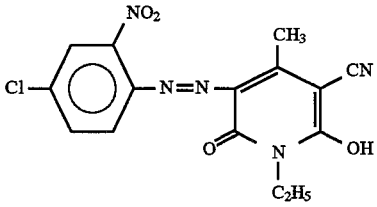 | (30) | R-400R (Cabot) | 70:30 |

TABLE 5-continued

| Composition No. | Charge Cotrolling Agent (A) | Compound (No.) | Carbon (B) | Ratio by weight (A):(B) |
|---|---|---|---|---|
| 34 | 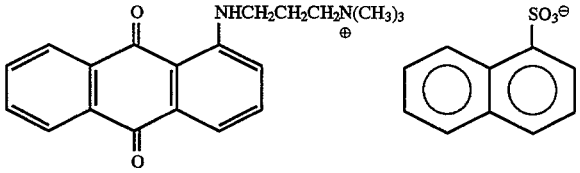 | (31) | R-400R (Cabot) | 95:5 |
| 35 | $CuPc\leftarrow SO_3H.H_2N(CH_2)_{17}CH_3)_4$ Pc = phthalocyanine residue | (32) | R-400R (Cabot) | 85:15 |
| 36 | 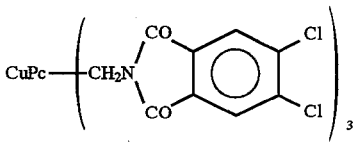 Pc = phthalocyanine residue | (33) | #4000B (Mitsubishi Kasei Corp.) | 70:30 |
| 37 | 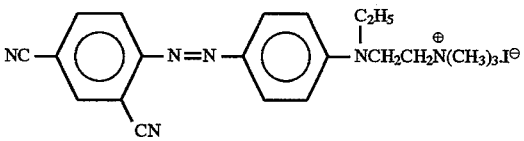 | (34) | #4000B (Mitsubishi Kasei Corp.) | 25:75 |
| 38 | 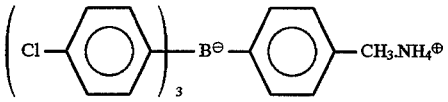 | (35) | #4000B (Mitsubishi Kasei Corp.) | 90:10 |

TABLE 6

| Composition No. | Charge Cotrolling Agent (A) | Compound (No.) | Carbon (B) | Ratio by weight (A):(B) |
|---|---|---|---|---|
| 39 | 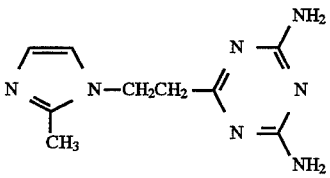 | (36) | #400B (Mitsubishi Kasei Corp.) | 50:50 |
| 40 | 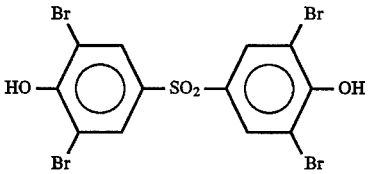 | (37) | #400B (Mitsubishi Kasei Corp.) | 80:20 |

TABLE 7

| | | | | Evaluation of Toner | | | | | |
|---|---|---|---|---|---|---|---|---|---|
| | | | | Charge Quantity (μC/g) | | Image Quality | | | |
| Ex. No. | Composition No. | Resin | Colorant | Initial Stage | After 50,000 Copies | Initial Stage | After 50,000 Copies | Environmental Preservability | Fog/Toner Scattering |
| 4 | 5 | A | #44 (Mitsubishi | 10.8 | 11.0 | ○ | ○ | ○ | ○/○ |

TABLE 7-continued

| Ex. No. | Composition No. | Resin | Colorant | Evaluation of Toner: Charge Quantity (μC/g) Initial Stage | Charge Quantity (μC/g) After 50,000 Copies | Image Quality Initial Stage | Image Quality After 50,000 Copies | Environmental Preservability | Fog/Toner Scattering |
|---|---|---|---|---|---|---|---|---|---|
| 5 | 6 | A | Kasei Corp.) #44 (Mitsubishi Kasei Corp.) | 12.1 | 11.9 | ○ | ○ | ○ | ○/○ |
| 6 | 7 | A | #44 (Mitsubishi Kasei Corp.) | 10.5 | 10.6 | ○ | ○ | ○ | ○/○ |
| 7 | 8 | C | #44 (Mitsubishi Kasei Corp.) | 15.5 | 15.4 | ○ | ○ | ○ | ○/○ |
| 8 | 9 | A | #44 (Mitsubishi Kasei Corp.) | 11.0 | 11.4 | ○ | ○ | ○ | ○/○ |
| 9 | 10 | E | R-300 (Cabot) | 13.0 | 12.9 | ○ | ○ | ○ | ○/○ |
| 10 | 11 | A | R-300 (Cabot) | 11.0 | 11.3 | ○ | ○ | ○ | ○/○ |
| 11 | 12 | A | R-300 (Cabot) | 10.5 | 10.8 | ○ | ○ | ○ | ○/○ |
| 12 | 13 | D | R-300 (Cabot) | 13.2 | 12.9 | ○ | ○ | ○ | ○/○ |
| 13 | 14 | D | R-300 (Cabot) | 14.0 | 14.3 | ○ | ○ | ○ | ○/○ |
| 14 | 15 | A | R-300 (Cabot) | 13.2 | 13.0 | ○ | ○ | ○ | ○/○ |
| 15 | 16 | A | C.I. Pigment Red 122 | 13.5 | 13.4 | ○ | ○ | ○ | ○/○ |
| 16 | 17 | A | C.I. Pigment Blue 15 | 15.5 | 15.3 | ○ | ○ | ○ | ○/○ |
| 17 | 19 | C | C.I. Pigment Blue 15 | 12.0 | 12.1 | ○ | ○ | ○ | ○/○ |
| 18 | 21 | C | C.I. Pigment Blue 15 | 11.2 | 11.5 | ○ | ○ | ○ | ○/○ |
| 19 | 22 | A | #44 (Mitsubishi Kasei Corp.) | 14.0 | 13.8 | ○ | ○ | ○ | ○/○ |
| 20 | 22 | C | #44 (Mitsubishi Kasei Corp.) | 16.1 | 15.9 | ○ | ○ | ○ | ○/○ |
| 21 | 25 | C | #44 (Mitsubishi Kasei Corp.) | 14.7 | 14.5 | ○ | ○ | ○ | ○/○ |

TABLE 8

| Ex. No. | Composition No. | Resin | Colorant | Evaluation of Toner: Charge Quantity (μC/g) Initial Stage | Charge Quantity (μC/g) After 50,000 Copies | Image Quality Initial Stage | Image Quality After 50,000 Copies | Environmental Preservability | Fog/Toner Scattering |
|---|---|---|---|---|---|---|---|---|---|
| 22 | 29 | B | " | −13.2 | −13.0 | ○ | ○ | ○ | ○/○ |
| 23 | 30 | B | " | −15.3 | −15.1 | ○ | ○ | ○ | ○/○ |
| 24 | 34 | B | Magnetic powder | 15.0 | 15.1 | ○ | ○ | ○ | ○/○ |
| 25 | 33 | C | R-600R (Cabot) | 13.6 | 13.2 | ○ | ○ | ○ | ○/○ |
| 26 | 39 | D | R-600R (Cabot) | 12.5 | 12.3 | ○ | ○ | ○ | ○/○ |
| 27 | 40 | E | R-600R (Cabot) | −11.2 | −11.0 | ○ | ○ | ○ | ○/○ |

TABLE 9

| Comp. Ex. No. | Compound (A) | Carbon (B) | A:B | Resin | Colorant | Evaluation of Toner: Charge Quantity (μC/g) Initial Stage | Charge Quantity (μC/g) After 50,000 Copies | Image Quality Initial Stage | Image Quality After 50,000 Copies | Environmental Preservability | Fog/Toner Scattering |
|---|---|---|---|---|---|---|---|---|---|---|---|
| 3 | 2 | R-300 (Cabot) | 30:70 | A | #44 (Mitsubishi Kasei Corp.) | 8.3 | 6.2 | x | x | x | x/x |
| 4 | 3 | R-300 (Cabot) | 80:20 | A | #44 (Mitsubishi Kasei Corp.) | 9.0 | 8.0 | x | x | x | x/x |
| 5 | 4 | R-300 (Cabot) | 40:60 | A | #44 (Mitsubishi Kasei Corp.) | 8.2 | 7.1 | x | x | x | x/x |
| 6 | 5 | #44 (Mitsubishi Kasei Corp.) | 60:40 | C | #44 (Mitsubishi Kasei Corp.) | 9.9 | 8.5 | o | x | x | x/x |
| 7 | 6 | #44 (Mitsubishi Kasei Corp.) | 90:10 | A | #44 (Mitsubishi Kasei Corp.) | 6.3 | 6.1 | x | x | x | x/x |
| 8 | 7 | #44 (Mitsubishi Kasei Corp.) | 30:70 | E | R-300 (Cabot) | 9.2 | 8.2 | x | x | x | x/x |
| 9 | 8 | ELFTEX-8 (Cabot) | 50:50 | A | R-300 (Cabot) | 5.5 | 4.9 | x | x | x | x/x |
| 10 | 9 | ELFTEX-8 (Cabot) | 50:50 | A | R-300 (Cabot) | 8.6 | 7.4 | x | x | x | x/x |
| 11 | 10 | ELFTEX-8 (Cabot) | 10:90 | D | R-300 (Cabot) | 10.3 | 9.0 | o | x | x | x/x |
| 12 | 11 | ELFTEX-8 (Cabot) | 25:75 | D | R-300 (Cabot) | 8.2 | 7.4 | x | x | x | x/x |
| 13 | 12 | ELFTEX-8 (Cabot) | 50:50 | A | R-300 (Cabot) | 10.2 | 8.5 | o | x | x | x/x |
| 14 | 13 | #44 (Mitsubishi Kasei Corp.) | 90:10 | A | C.I. Pigment Red 122 | 8.3 | 6.1 | x | x | x | x/x |

TABLE 10

| Comp. Ex. No. | Compound (A) | Carbon (B) | A:B | Resin | Colorant | Evaluation of Toner: Charge Quantity (μC/g) Initial Stage | Charge Quantity (μC/g) After 50,000 Copies | Image Quality Initial Stage | Image Quality After 50,000 Copies | Environmental Preservability | Fog/Toner Scattering |
|---|---|---|---|---|---|---|---|---|---|---|---|
| 15 | 14 | R-400R (Cabot) | 90:10 | A | C.I. Pigment Blue 15 | 7.9 | 6.6 | x | x | x | x/x |
| 16 | 16 | R-400R (Cabot) | 80:20 | C | C.I. Pigment Blue 15 | 9.9 | 8.0 | x | x | x | x/x |
| 17 | 18 | #44 (Mitsubishi Kasei Corp.) | 80:20 | C | C.I. Pigment Blue 15 | 9.8 | 7.3 | o | x | x | x/x |
| 18 | 19 | #44 (Mitsubishi Kasei Corp.) | 50:50 | A | #44 (Mitsubishi Kasei Corp.) | 10.1 | 8.9 | x | x | x | x/x |
| 19 | 19 | #44 (Mitsubishi Kasei Corp.) | 50:50 | C | #44 (Mitsubishi Kasei Corp.) | 9.3 | 8.3 | x | x | x | x/x |
| 20 | 22 | R-300 (Cabot) | 20:80 | C | #44 (Mitsubishi Kasei Corp.) | 8.7 | 6.6 | x | x | x | x/x |
| 21 | 26 | #20B (Mitsubishi Kasei Corp.) | 10:90 | B | #44 (Mitsubishi Kasei Corp.) | −8.5 | −6.9 | x | x | x | x/x |
| 22 | 27 | #20B (Mitsubishi | 70:30 | B | #44 (Mitsubishi | −10.2 | −8.3 | o | x | x | x/x |

TABLE 10-continued

| Comp. Ex. No. | Compound (A) | Carbon (B) | A:B | Resin | Colorant | Evaluation of Toner: Charge Quantity (μC/g) Initial Stage | Charge Quantity (μC/g) After 50,000 Copies | Image Quality Initial Stage | Image Quality After 50,000 Copies | Environmental Preservability | Fog/Toner Scattering |
|---|---|---|---|---|---|---|---|---|---|---|---|
| 23 | 31 | Kasei Corp.) R-400R (Cabot) | 95:5 | B | Kasei Corp.) Magnetic powder | 9.8 | 9.7 | x | x | x | x/x |
| 24 | 34 | #400B (Mitsubishi Kasei Corp.) | 85:15 | C | R-600R (Cabot) | 10.3 | 9.2 | x | x | x | x/x |
| 25 | 36 | #400B (Mitsubishi Kasei Corp.) | 50:50 | D | R-600R (Cabot) | 8.9 | 8.0 | x | x | x | x/x |
| 26 | 37 | #400B (Mitsubishi Kasei Corp.) | 80:20 | E | R-600R (Cabot) | −6.7 | −6.0 | x | x | x | x/x |

EXAMPLE 28

A mixture of 19.9 parts of 4,6-dinitro-2-aminophenol, 10 parts of concentrated hydrochloric acid and 400 parts of water was stirred and cooled with ice to 0° to 5° C., and 6.9 parts of sodium nitrite was added thereto. The mixture was stirred at that temperature for 2 hours to carry out diazotization. The resulting diazo compound was introduced into a mixed solution of 300 parts of water, 10 parts of sodium hydroxide and 26.3 parts of 3-hydroxy-2-naphthoanilide at 0° to 5° C., and a coupling reaction was carried out, thereby obtaining a monoazo compound. The paste of the monoazo compound was recovered by filtration and dissolved in 150 parts of ethylene glycol, and 5 parts of sodium hydroxide and 17.4 parts of sodium chromium salicylate were added thereto. The mixture was stirred at 110° to 120° C. for 2 hours, thereby effecting chromatization. The reaction mixture was then cooled to 50° C., and 10 parts of hydrochloric acid was added thereto to make it acidic against Congo Red. Subsequently, 350 parts of carbon (REGAL 400R, a product of Cabot) was added thereto, and the mixture was stirred for 2 hours, recovered by filtration and dried to obtain a composition 41. The resulting composition 41 was composed of the following compound (38) and carbon in a ratio of 5:35.

(Compound 38)

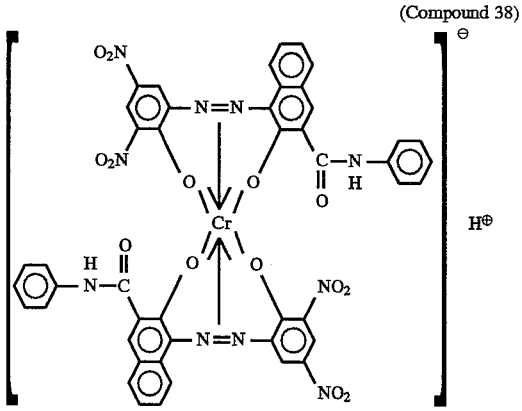

Subsequently, 16 parts of the composition 41 and 200 parts of a styrene-acrylic copolymer resin (Himer TB1000, a product of Sanyo Kagaku Kogyo K.K.) were premixed and then kneaded with heating in a heated twin screw kneader for 10 minutes. The mixture was then cooled, pulverized in a jet mill and classified by using a gas stream classifier to obtain particles having an average particle size of 5 to 25 μm. The surfaces of the particles were treated with colloidal silica (R-972, a product of Nippon Aerosil K.K.) to obtain a toner.

A developer was prepared by mixing 5 parts of the toner with 100 parts of iron powder carrier (TEFV 200/300, a product of Nippon Teppun K.K.).

The developer was placed in a development device, and continuous copying was conducted to carry out an image test. The initial charge quantity of the toner after the 10,000th copy was −25.4 μC/g, and a clear black image was obtained. The image quality and the charge quantity were not changed even after 200,000 copies were obtained, and the scattering of the toner and offset did not occur.

Further, copying was conducted under high temperature and humidity conditions at 35° C. and 85% RH and under low temperature and humidity conditions at 10° C. and 30% RH. An image quality substantially equal to that obtained by conducting copying under ordinary temperature and humidity environmental conditions was obtained, and the scattering of the toner and offset did not occur.

Comparative Example 27

Two parts of the compound (38), 14 parts of carbon (REGAL 400R, a product of Cabot) and 200 parts of a styrene-acrylic copolymer resin (Himer TB1000, a product of Sanyo Kasei Kogyo K.K.) were premixed and then kneaded with heating in a heated twin screw kneader for 10 minutes. The mixture was cooled, pulverized in a jet mill and classified by using a gas steam classifier to obtain particles having an average particle size of 5 to 25 μm. The surfaces of the particles were treated with colloidal silica (R-972, a product of Nippon Aerosil K.K.) to obtain a toner.

In the same manner as in Example 28, an image test was carried out. The initial charge quantity of the toner after 10,000th copy was lowered to −24.0 μC/g, though the image was black and clear. After the 200,000th copy, the charge quantity was lowered to −17.3 μC/g, and the image was not clear. Further, fog and toner scattering occurred.

Compositions 42 to 62 shown in Tables 11 to 18 below were prepared by adding carbon to the charge controlling agent after completion of the reaction in the same manner as in Example 28, and the compositions were used in Examples 29 to 42. For the purpose of comparison, toners were prepared by using the charge controlling agent and carbon in the same manner as in Comparative Example 27, and the toners were used in Comparative Examples 28 to 41. The results obtained are shown in Tables 19 to 22 below.

Resins used and the criteron of each evaluation are as follows.

The following resins were used in the preparation of the toners.

A: Styrene-acrylic acid copolymer (Himer SBM-73, a product of Sanyo Kasei K.K.)

B: Styrene-acrylic acid copolymer (Himer TB-1000, a product of Sanyo Kasei K.K.)

C: Polyester (HP-313, a product of Nippon Gosei Kagaku K.K.)

D: Polyester (HP-320, a product of Nippon Gosei Kagaku K.K.)

E: Polyester (average molecular weight: 15,000)

F: Styrene-n-butyl acrylic copolymer (average molecular weight: 20,000)

G: Polyethylene-vinyl acetate copolymer (average molecular weight: 18,000)

The charge quantity of the toner was determined by measuring the charge quantity in the initial stage of running and after the 50,000th copy by means of the blow-off method. The criterion is as follows.

The mark ○: There is practically no problem.

The mark X: There is practically a problem.

TABLE 11

| Composition | Charge Controlling Agent (A) | | | | | Compound | Carbon | Ratio by weight |
|---|---|---|---|---|---|---|---|---|
| No. | C | D | M | X | (No.) | (B) | (A):(B) |
| 42 | 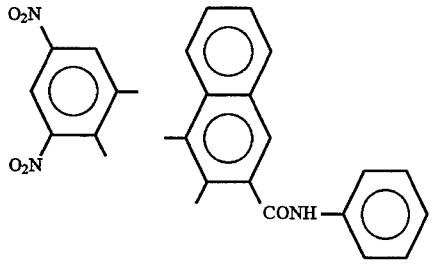 | | Cr | $NH_4$ | 39 | R-400R (Cabot) | 10:40 |
| 43 | 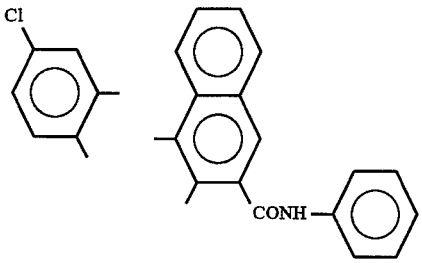 | | Fe | $NH_4$ | 40 | R-600R (Cabot) | 10:35 |
| 44 | 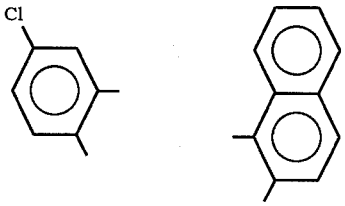 | | Cr | H | 41 | R-400R (Cabot) | 9:41 |

TABLE 12
Charge Controlling Agent (A)
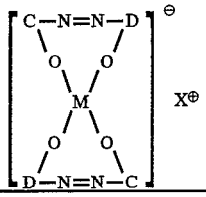
| Composition No. | C | D | M | X | Compound (No.) | Carbon (B) | Ratio by weight (A):(B) |
|---|---|---|---|---|---|---|---|
| 45 | 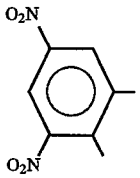 | 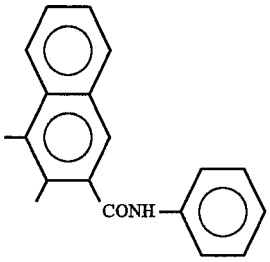 | Co | 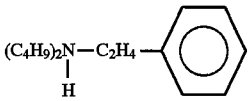 | 42 | R-300R (Cabot) | 7:38 |
| 46 | 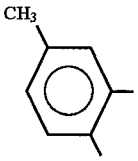 | 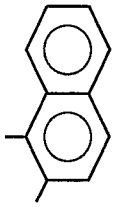 | Cr | K | 43 | R-99R (Cabot) | 5.2:25 |
| 47 | 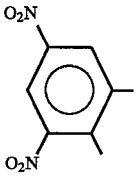 | 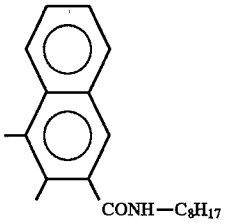 | Cr | Na | 44 | Monarch 1100 (Cabot) | 35:39 |
TABLE 13
Charge Controlling Agent (A)
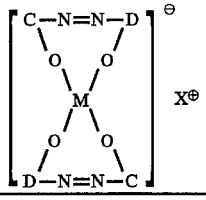
| Composition No. | C | D | M | X | Compound (No.) | Carbon (B) | Ratio by weight (A):(B) |
|---|---|---|---|---|---|---|---|
| 48 | 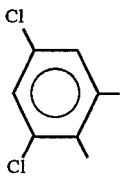 | 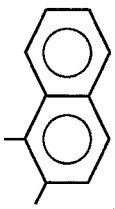 | Cr | $C_4H_9-CH(C_2H_5)-NH_3$ | 45 | R-500R (Cabot) | 6:35 |

TABLE 13-continued

| Composition No. | Charge Controlling Agent (A) C | D | M | X | Compound (No.) | Carbon (B) | Ratio by weight (A):(B) |
|---|---|---|---|---|---|---|---|
| 49 | $CH_3O$ | CONH—H | Fe | $NH_4$ | 46 | #1000 (Mitsubishi Kasei Corp.) | 50:50 |
| 50 | $O_2N$, Cl | CONH—Cl, $OCH_3$ | Cr | H | 47 | #1000 (Mitsubishi Kasei Corp.) | 30:70 |

TABLE 14

| Composition No. | Charge Controlling Agent (A) C | D | M | X | Compound (No.) | Carbon (B) | Ratio by weight (A):(B) |
|---|---|---|---|---|---|---|---|
| 51 | Cl | | Co | $C_{12}H_{25}CH(OH)CH_2N(CH_3)_2-CH_2-$ | 48 | R-300R (Cabot) | 7:35 |

TABLE 14-continued
| Composition | Charge Controlling Agent (A) | | | | Compound | Carbon | Ratio by weight |
|---|---|---|---|---|---|---|---|
| No. | C | D | M | X | (No.) | (B) | (A):(B) |
| 52 | 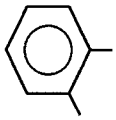 | 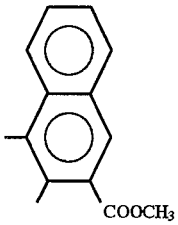 | Cr | $C_{12}H_{25}NH_2C_2H_4OH$ | 49 | #30 (Mitsubishi Kasei Corp.) | 9:41 |
| 53 | $CH_3NHO_2S$ 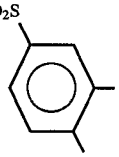 | 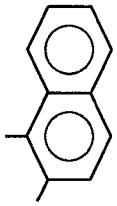 | Cr | Na | 50 | R-500R (Cabot) | 30:35 |
TABLE 15
| Composition | Charge Controlling Agent (A) | | | | Compound | Carbon | Ratio by weight |
|---|---|---|---|---|---|---|---|
| No. | C | D | M | X | (No.) | (B) | (A):(B) |
| 54 | HOOC 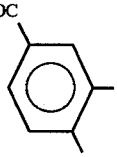 | 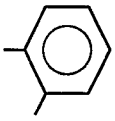 | Fe | n-$C_{18}H_{37}NH_3$ | 51 | R-500R (Cabot) | 90:10 |
| 55 | $HO_3S$ 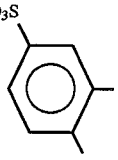 | 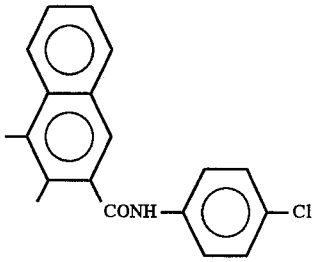 | Fe | $NH_4$ | 52 | R-500R (Cabot) | 95:5 |

TABLE 15-continued
Composition — Charge Controlling Agent (A)
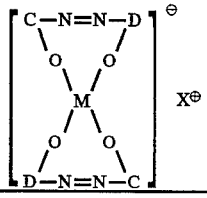
| No. | C | D | M | X | Compound (No.) | Carbon (B) | Ratio by weight (A):(B) |
|---|---|---|---|---|---|---|---|
| 56 | 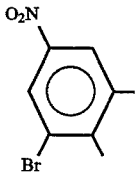 | 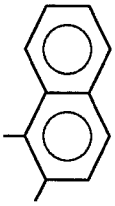 | Fe | Na | 53 | #44 (Mitsubishi Kasei Corp.) | 50:50 |
TABLE 16
Composition — Charge Controlling Agent (A)
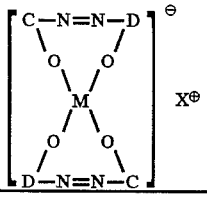
| No. | C | D | M | X | Compound (No.) | Carbon (B) | Ratio by weight (A):(B) |
|---|---|---|---|---|---|---|---|
| 57 | 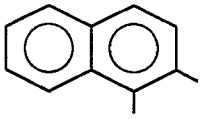 | 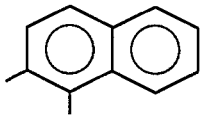 | Ti | — | 54* | #44 Mitsubishi Kasei Corp.) | 75;25 |
| 58 | 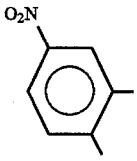 | 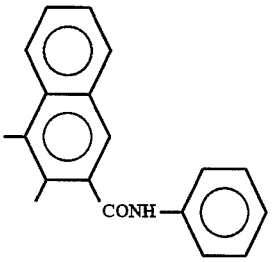 | Si | — | 55* | #44 Mitsubishi Kasei Corp.) | 30:70 |
*In the case of Ti and Si complex salt dyes, there is no counter ion.

TABLE 17

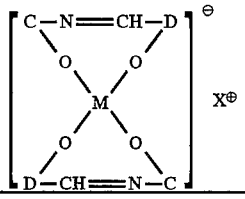

| Composition No. | Charge Controlling Agent (A) C | D | M | X | Compound (No.) | Carbon (B) | Ratio by weight (A):(B) |
|---|---|---|---|---|---|---|---|
| 59 | 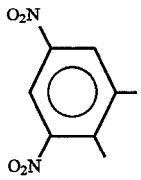 | 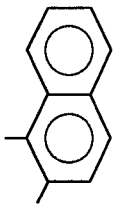 | Si | — | 56* | #44 (Mitsubishi Kasei Corp.) | 50:50 |
| 60 | 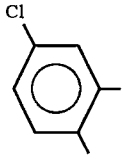 | 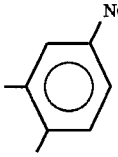 | Ti | — | 57* | #44 (Mitsubishi Kasei Corp.) | 25:75 |

*In the case of Ti and Si complex salt dyes, there is no counter ion.

TABLE 18

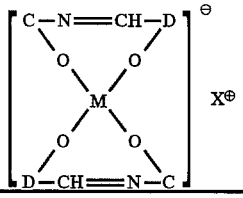

| Composition No. | Charge Controlling Agent (A) C | D | M | X | Compound (No.) | Carbon (B) | Ratio by weight (A):(B) |
|---|---|---|---|---|---|---|---|
| 61 | 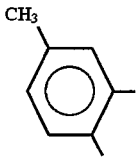 | 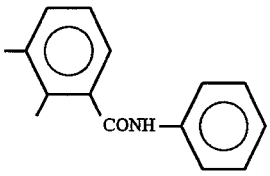 | Zr | — | 58* | R-400R (Cabot) | 80:20 |
| 62 | 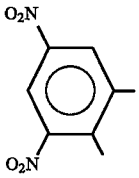 | 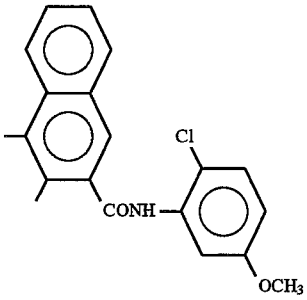 | Fe | $NH_4$ | 59 | R-400R (Cabot) | 90:10 |

*In the case of Zr complex salt dye, there is no counter ion.

TABLE 19

| Ex. No. | Composition No. | Resin | Colorant | Evaluation of Toner: Charge Quantity (μC/g) Initial Stage | Charge Quantity (μC/g) After 50,000 Copies | Image Quality Initial Stage | Image Quality After 50,000 Copies | Environmental Preservability | Fog/Toner Scattering |
|---|---|---|---|---|---|---|---|---|---|
| 29[1)] | 42 | F | R-400R (Cabot) | −20.6 | −20.3 | ○ | ○ | ○ | ○/○ |
| 30[1)] | 43 | F | R-600R (Cabot) | −22.5 | −22.3 | ○ | ○ | ○ | ○/○ |
| 31 | 44 | B | R-400R (Cabot) | −21.0 | −21.3 | ○ | ○ | ○ | ○/○ |
| 32[2)] | 45 | C | R-300R (Cabot) | −19.0 | −19.2 | ○ | ○ | ○ | ○/○ |
| 33 | 49 | G | #1000 (Mitsubishi Kasei Corp.) | −20.8 | −20.7 | ○ | ○ | ○ | ○/○ |
| 34 | 53 | B | R-500R (Cabot) | −21.0 | −21.8 | ○ | ○ | ○ | ○/○ |
| 35 | 54 | A | R-500R (Cabot) | −22.3 | −22.0 | ○ | ○ | ○ | ○/○ |
| 36 | 55 | B | R-500R (Cabot) | −19.3 | −19.5 | ○ | ○ | ○ | ○/○ |
| 37 | 56 | C | #44 (Mitsubishi Kasei Corp.) | −23.5 | −23.7 | ○ | ○ | ○ | ○/○ |
| 38[2)] | 57 | G | #44 (Mitsubishi Kasei Corp.) | −20.3 | −20.0 | ○ | ○ | ○ | ○/○ |

[1)]Ferrite carrier was used in place of iron powder carrier.
[2)]Fluororesin-coated ferrite carrier was used in place of iron powder carrier.

TABLE 20

| Ex. No. | Composition No. | Resin | Colorant | Evaluation of Toner: Charge Quantity (μC/g) Initial Stage | Charge Quantity (μC/g) After 50,000 Copies | Image Quality Initial Stage | Image Quality After 50,000 Copies | Environmental Preservability | Fog/Toner Scattering |
|---|---|---|---|---|---|---|---|---|---|
| 39 | 59 | A | #44 (Mitsubishi Kasei Corp.) | −23.6 | −23.5 | ○ | ○ | ○ | ○/○ |
| 40 | 60 | B | #44 (Mitsubishi Kasei Corp.) | −22.3 | −22.0 | ○ | ○ | ○ | ○/○ |
| 41 | 61 | C | R-400R (Cabot) | −19.0 | −19.3 | ○ | ○ | ○ | ○/○ |
| 42 | 62 | C | R-400R (Cabot) | −19.4 | −19.2 | ○ | ○ | ○ | ○/○ |

TABLE 21

| Comp. Ex. No. | Compound (A) | Carbon (B) | A:B | Resin | Colorant | Evaluation of Toner: Charge Quantity (μC/g) Initial Stage | Charge Quantity (μC/g) After 50,000 Copies | Image Quality Initial Stage | Image Quality After 50,000 Copies | Environmental Preservability | Fog/Toner Scattering |
|---|---|---|---|---|---|---|---|---|---|---|---|
| 28[1)] | 39 | R-400R (Cabot) | 10:40 | F | R-400R (Cabot) | −19.3 | −16.2 | o | x | x | x/x |
| 29[1)] | 40 | R-600R (Cabot) | 10:35 | F | R-600R (Cabot) | −19.0 | −16.9 | o | x | x | x/x |
| 30 | 41 | R-400R (Cabot) | 9:41 | B | R-400R (Cabot) | −18.3 | −15.8 | o | x | x | x/x |
| 31[2)] | 42 | R-300R (Cabot) | 7:38 | C | R-300R (Cabot) | −17.0 | −15.5 | x | x | x | x/x |
| 32 | 46 | #1000 (Mitsubishi Kasei Corp.) | 50:50 | G | #1000 (Mitsubishi Kasei Corp.) | −19.2 | −17.2 | x | x | x | x/x |
| 33 | 50 | R-500R (Cabot) | 30:35 | B | R-500R (Cabot) | −18.3 | −15.5 | x | x | x | x/x |
| 34 | 51 | R-500R (Cabot) | 90:10 | A | R-500R (Cabot) | −18.8 | −15.0 | x | x | x | x/x |
| 35 | 52 | R-500R (Cabot) | 95:5 | B | R-500R (Cabot) | −17.9 | −15.8 | x | x | x | x/x |
| 36 | 53 | #44 (Mitsubishi Kasei Corp.) | 50:50 | C | #44 (Mitsubishi Kasei Corp.) | −19.0 | −16.9 | x | x | x | x/x |
| 37[2)] | 54 | #44 (Mitsubishi Kasei Corp.) | 75:25 | G | #44 (Mitsubishi Kasei Corp.) | −18.7 | −14.0 | x | x | x | x/x |

[1)]Ferrite carrier was used in place of iron powder carrier.
[2)]Fluororesin-coated ferrite carrier was used in place of iron powder carrier.

TABLE 22

| Comp. Ex. No. | Compound (A) | Carbon (B) | A:B | Resin | Colorant | Evaluation of Toner: Charge Quantity (μC/g) Initial Stage | Charge Quantity (μC/g) After 50,000 Copies | Image Quality Initial Stage | Image Quality After 50,000 Copies | Environmental Preservability | Fog/Toner Scattering |
|---|---|---|---|---|---|---|---|---|---|---|---|
| 38 | 56 | #44 (Mitubishi Kasei Corp.) | 50:50 | A | #44 (Mitsubishi Kasei Corp.) | −18.3 | −17.0 | x | x | x | x/x |
| 39 | 57 | #44 (Mitubishi Kasei Corp.) | 25:75 | B | #44 (Mitsubishi Kasei Corp.) | −17.7 | −15.3 | x | x | x | x/x |
| 40 | 58 | R-400R (Cabot) | 80:20 | C | R-400R (Cabot) | −18.0 | −16.7 | x | x | x | x/x |
| 41 | 59 | R-400R (Cabot) | 90:10 | C | R-400R (Cabot) | −17.0 | −15.6 | x | x | x | x/x |

INDUSTRIAL POSSIBILITY OF THE INVENTION

In the thus-obtained charge controlling agent composition of the present invention, the primary particles of the charge controlling agent and finely divided carbon particles are very well-dispersed in each other, and the charge controlling agent composition has excellent dispersibility in the resin. Further, the charge controlling agent composition of the present invention as such after drying can be used in the preparation of the toner. If desired, the charge controlling agent composition of the present invention may be further pulverized, classified and used.

The toner containing the charge controlling agent composition of the present invention has good rise of charging and is freed from the problems of charging unstableness and scattering associated with conventional toners, even when the toner containing the charge controlling agent composition of the present invention is used under low temperature and humidity conditions or under high temperature and humidity conditions for many hours. As a result, a clear copied image can be obtained.

We claim:

1. A charge controlling agent composition, which is produced by adding carbon black after completion of the synthetic reaction of a charge controlling agent.

2. A charge controlling composition comprising at least one charge controlling agent and carbon black, wherein the composition is produced by adding carbon black to the at least one charge controlling agent in wet form to form a wet mixture thereof, and drying the mixture.

3. A charge controlling agent composition as claimed in claim 2, wherein the charge controlling agent is a metal complex salt dye, a triarylmethane basic dye, a nigrosine dye, a phthalocyanine, a xanthene dye or pigment, a metal complex salt of an organic carboxylic acid, a tetraaryl borate salt or a quaternary ammonium salt.

4. A toner for electrophotography which contains a charge controlling agent composition as claimed in claim 2.

* * * * *